US006099057A

United States Patent [19]

Novak-Taurman et al.

[11] Patent Number: 6,099,057

[45] Date of Patent: Aug. 8, 2000

[54] FIRE HYDRANT LIFTING AND SETTING DEVICE

[75] Inventors: Sandra Novak-Taurman; Wayne Taurman, both of Centralia, Wash.

[73] Assignee: Taurman Distributing & Manufacturing, Inc., Centralia, Wash.

[21] Appl. No.: 09/378,199

[22] Filed: Aug. 19, 1999

Related U.S. Application Data

[63] Continuation of application No. 08/971,771, Nov. 17, 1997, Pat. No. 5,975,603.

[51] Int. Cl.[7] ..... B66C 1/62

[52] U.S. Cl. ..... 294/67.3; 294/81.5; 294/90

[58] Field of Search ..... 294/67.1, 67.3, 294/67.31, 67.4, 67.5, 68.27, 74, 90, 81.2–81.5, 81.51, 81.55, 81.56; 137/272, 296

[56] References Cited

U.S. PATENT DOCUMENTS

| | | | |
|---|---|---|---|
| 1,032,271 | 7/1912 | Bransfield | 294/68.27 |
| 1,473,013 | 11/1923 | Clark . | |
| 1,774,623 | 9/1930 | Williams | 294/67.3 X |
| 2,136,443 | 11/1938 | Kepler | 294/81.51 |
| 2,384,307 | 5/1945 | Husson et al. | 294/67.31 |
| 2,409,684 | 10/1946 | Jenkins . | |
| 2,721,757 | 10/1955 | Anderson | 294/81.2 |
| 2,860,002 | 11/1958 | Herbst | 294/81.5 X |
| 2,875,982 | 3/1959 | Unglesby | 294/90 X |
| 3,010,751 | 11/1961 | Day et al. | 294/81.2 |
| 3,020,078 | 2/1962 | Ray | 294/63.1 |
| 3,215,464 | 11/1965 | Overman | 294/90 |
| 3,314,711 | 4/1967 | Dietz et al. | 294/81.5 X |
| 3,343,861 | 9/1967 | Sinicki | 294/67.3 X |
| 3,549,190 | 12/1970 | Caldwell | 294/81.5 X |
| 4,392,679 | 7/1983 | Barnes et al. | 294/67.1 X |
| 4,706,939 | 11/1987 | Gagne | 254/332 |
| 4,736,765 | 4/1988 | Campbell | 137/296 |
| 4,951,989 | 8/1990 | Goodin | 294/90 |
| 5,033,501 | 7/1991 | Stehling | 137/296 |
| 5,445,426 | 8/1995 | Sorensen | 294/67.3 |

FOREIGN PATENT DOCUMENTS

| | | | |
|---|---|---|---|
| 158541 | 1/1983 | Germany | 294/67.3 |
| 236196 | 9/1989 | Japan | 294/67.3 |
| 378510 | 4/1973 | U.S.S.R. | 294/81.5 |
| 379510 | 4/1973 | U.S.S.R. | 294/81.5 |
| 1172-862 | 8/1985 | U.S.S.R. | 294/67.3 |

*Primary Examiner*—Johnny D. Cherry
*Attorney, Agent, or Firm*—Michael J. Donohue; Seed IP Law Group PLLC

[57] ABSTRACT

A fire hydrant lifting harness includes a lifting triangle, a pair of connecting cables, and a pair of rigid paddles. The lifting triangle includes two bracing members, one each at two corners, forming eyelets therein. For each eyelet, a cable passes through it and the cable is wound around itself. The other end of each cable is attached to a respective lifting paddle in a similar manner. The paddle is made from a rigid material and includes a bend, between the two ends, so that the paddle does not contact the head of the fire hydrant. The end of the paddle opposite from where the cable connects includes an aperture designed to accommodate one of the ports from the fire hydrant. For lifting, the port cap is removed, the paddle is placed around the port and against the hydrant, and the port cap replaced. A lifting force then raises the fire hydrant lifting device which in turn raises the fire hydrant.

26 Claims, 3 Drawing Sheets

FIRE HYDRANT LIFTING AND SETTING DEVICE

CROSS-REFERENCE TO RELATED APPLICATION

This application is a continuation of U.S. patent application Ser. No. 08/971,771, filed Nov. 17, 1997 now U.S. Pat. No. 5,975,603.

TECHNICAL FIELD

The present invention relates to a harness used for lifting an object which has multiple projections, and more particularly for lifting and placing a fire hydrant.

BACKGROUND OF THE INVENTION

Fire hydrants are heavy objects, and occasionally must be moved. They are moved during installation, which often coincides with road construction. They are also moved for maintenance of the hydrant, or for maintenance of the water supply line to which the hydrant connects. Because of their weight, hydrants cannot be easily lifted by the installers. Therefore, some lifting force, for example a backhoe or front loader, is used to lift them.

When lifting a hydrant with a backhoe, an installer usually wraps a chain around a head of the hydrant and connects it to the lifting force. This method has a number of disadvantages. For instance, when wrapped around the head, the lifting part of the chain touches one side and is not centered above the fire hydrant. This causes the fire hydrant to be tilted from the vertical position during lifting, hindering installation. Additionally, the chain may slip over the head of the fire hydrant while being lifted, possibly causing damage to the fire hydrant.

Prior art tools and apparatus for setting fire hydrants are exemplified by U.S. Pat. No. 4,951,989 to Goodin and U.S. Pat. No. 4,706,939 to Gagne. The setting tool of Goodin includes a collar formed by flat steel plates which are placed underneath the head of the fire hydrant. The plates are secured by passing a pin through mounting guides on each plate. Goodin's collar assembly includes components which will become worn with use. Additionally, several assemblies are needed to accommodate differing hydrant sizes.

The setting tool of Gagne is used when separating the fire hydrant from an extension pipe connecting it to the water supply pipe. A mount is slipped around a flange of the extension pipe and secured with a clasping band. This type of tool cannot be used in the initial installation of the hydrant and extension pipe combination, because it uses the extension pipe for support. Further, a lifting chain directly contacts the head of the fire hydrant, possibly damaging it. Finally, coupling plates which slip over port cap studs on the hydrant are not secured, creating the possibility of the plates slipping off the studs when lifting the hydrant.

SUMMARY OF THE INVENTION

The inventive lifting apparatus is used for lifting objects having at least one projection extending therefrom. In an exemplary embodiment, one or more lifting arms temporarily attach to the object to be lifted. An aperture is provided through at least one of the lifting arms to receive one of the projections of the object. The lifting arm is secured to the object, so as not to become disengaged while lifting. The lifting arms are connected to a lifting device, and when the device lifts the arms, each arm transfers a portion of the lifting force from the lifting device to the projection of the object to be lifted, thereby lifting the object.

In one embodiment, two lifting arms may be held apart to obtain a lifting force which is evenly distributed to the object. The mechanism by which the arms are held apart can be any appropriate rigid surface, such as a lifting triangle. A further embodiment includes a coupling member such as a cable or chain used to connect the lifting arms to a bracket which holds the arms apart.

In a preferred embodiment, the lifting apparatus is used to lift a fire hydrant having protruding ports. The lifting apparatus includes an attachment member that is triangularly shaped and has eyelets in two corners. The corner without eyelets is attachable to the lifting device. One cable attaches at one end to each eyelet and at the other end to the lifting arm. At one end of the lifting arm, opposite from the attached cable, an aperture is sized to accept one of the protruding ports from the fire hydrant. Additionally, the lifting arms are bent such that when attached to the fire hydrant, the bend provides clearance around the head of the fire hydrant.

In operation, the lifting apparatus is attached to the fire hydrant as described above. The lifting device provides a lifting force to the apparatus, which is transferred to the hydrant. When the hydrant is being lifted from a horizontal position, such as laying on the ground or the bed of a truck, the lifting apparatus exerts a lifting force on the hydrant's ports and the hydrant rotates about the lower portion until it is lifted from its resting surface. The hydrant is positioned into place, secured, and the apparatus removed.

DETAILED DESCRIPTION OF THE INVENTION

Figure 1:
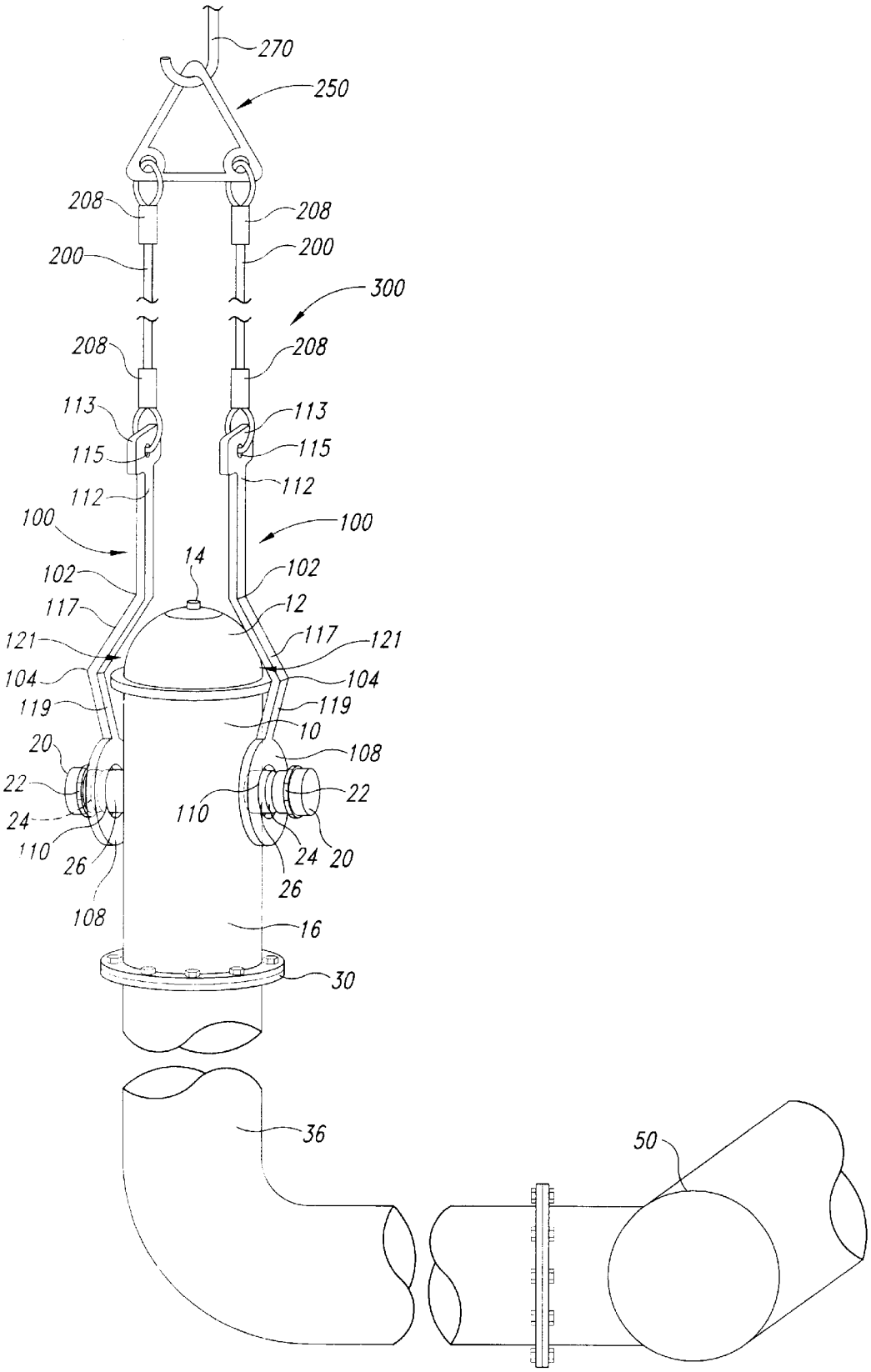
FIG. 1 is an isometric view of a lifting apparatus of the present invention shown with two lifting arms attached to a fire hydrant.

A fire hydrant 10 known in the prior art is shown in FIG. 1. The main components of the fire hydrant 10 include a body 16 having two ports 26 extending therefrom, and each port including external threads 24. Additionally, the topmost portion of the fire hydrant 10, generally called a head 12, is larger in circumference than the body 16. The ports 26 are each capped by a threaded port cap 20 which is held in place by tightening the threaded cap onto the port's external threads 24. A nut 22 secured to each port cap 20 allows the use of a wrench when removing or installing the port cap.

The fire hydrant 10 is secured to an extension pipe 36 at a flange 30. The extension pipe 36 is sized to extend from the bottom of the flange 30, typically installed near ground level, to a water supply pipe 50, which is usually located underground. Typical lengths of the extension pipe 36 are 3 to 5 feet and may include bends. When the fire hydrant 10 is delivered to an installation site, the extension pipe 36 is typically already attached to the flange 30 so the fire hydrant and extension pipe are connected to the water supply pipe 50 as a unit. The combination of the fire hydrant 10 and the extension pipe 36 can weigh several hundred pounds, thus there is a need to lift the hydrant with a lifting device so the fire hydrant is safely supported while installing or removing the fire hydrant from the water supply pipe 50.

A lifting harness 300 in accordance with an exemplary embodiment of the present invention is shown in FIG. 1 attached to the fire hydrant 10. The lifting harness 300 includes a pair of lifting paddles 100 removably attached at a lower end portion 108 to the fire hydrant's ports 26. An upper portion 112 of each lifting paddle 100 is connected to a lifting cable 200 or other suitable connection means, such as a chain or the like. The lifting cable 200, in turn, is attached to a lifting triangle 250 that is an attachment member removably connected to a hook 270 coupled to a backhoe (not shown) or other suitable lifting device. Accordingly, a lifting force from the lifting device is transmitted to the fire hydrant 10 by the lifting harness 300, so the fire hydrant and lifting harness are lifted as a unit.

Figure 2:
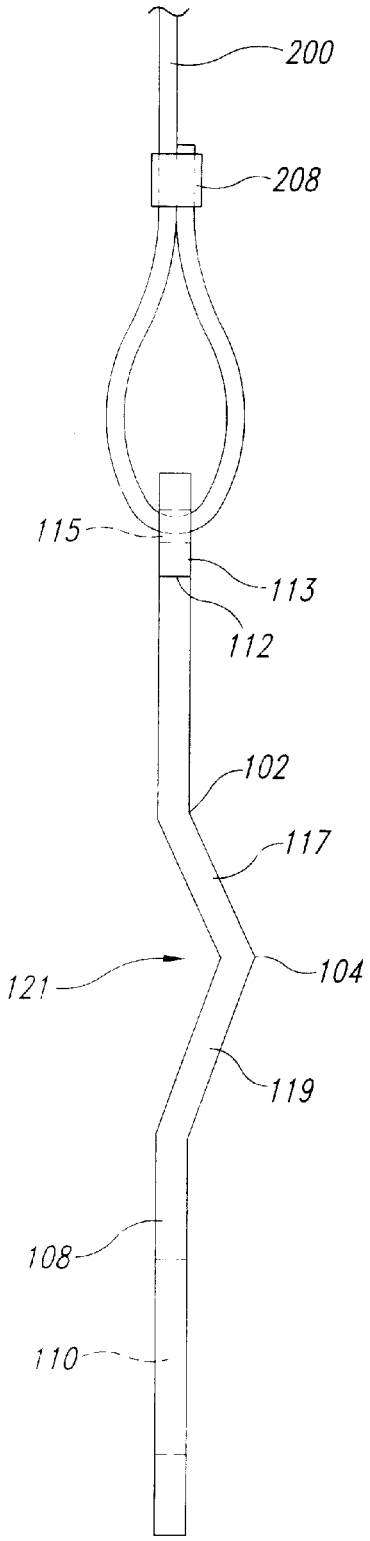
FIG. 2 is a partial left side view of one of the lifting arms of the lifting apparatus of FIG. 1.
Figure 3:
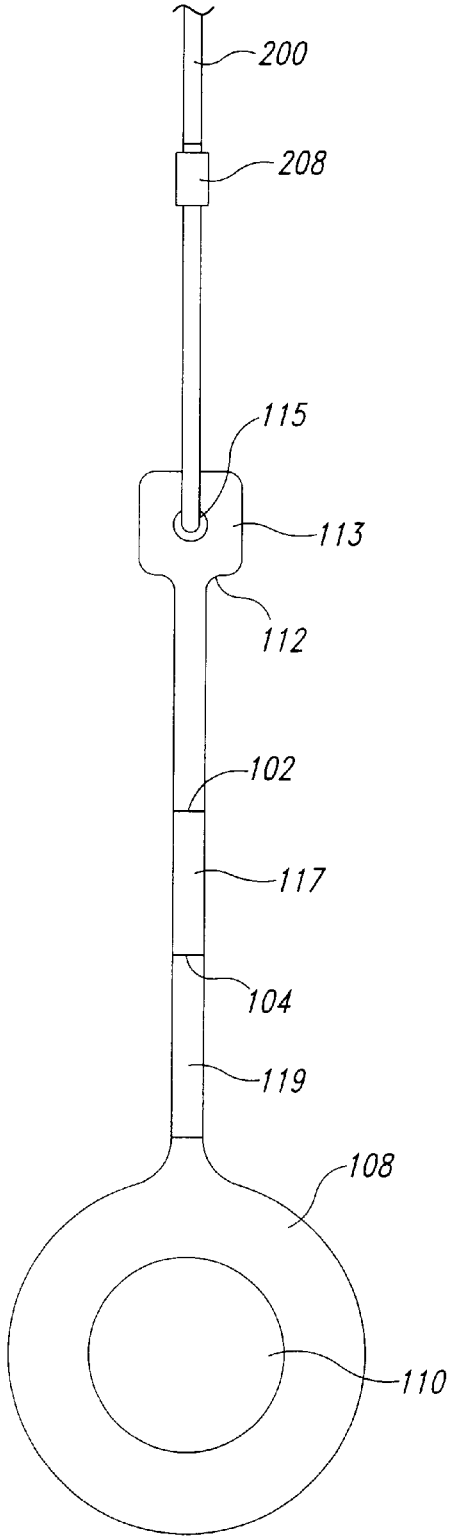
FIG. 3 is a partial front side view of the lifting arm of FIG. 1.

In the exemplary embodiment, the two lifting paddles 100 have the same configuration, so only one lifting paddle will be described herein and the description is applicable to both lifting paddles. As best seen in FIGS. 1, 2, and 3, the lifting paddle's lower end portion 108 is an enlarged disk-shaped portion that has an aperture 110 therein sized to removably receive the fire hydrant's port 26 therethrough when the lifting paddle 100 is attached to the fire hydrant 10 for lifting.

The aperture 110 has a diameter that is larger than the diameter of the fire hydrant's port 26 so the lower end portion easily slips over the port when the port cap 20 is removed. The diameter of the aperture 110, however, is smaller than the diameter of the port cap 20. When the lifting paddle's lower end portion 108 is positioned over a port 26 and the port cap 20 is then screwed onto the port, the lower end portion is trapped between the port cap and the fire hydrant's body 16 so the lifting paddle 100 cannot inadvertently slip off of the port during a lifting procedure. In the exemplary embodiment, the paddles 100 can rotate about the ports 26 when trapped thereon.

The lifting paddle 100 also has a body region 102 that is connected to the lower end portion 108 and that extends away from the lower end portion. The body region 102 includes a contoured section 104 having a contoured shape defined by a pair of interconnected upper and lower body segments 117 and 119. The lower body segment 119 is integrally attached to the lower end portion 108 at a selected angle relative thereto, and the upper body segment 117 is integrally connected to the lower body segment and spaced apart from the lifting paddle's lower end portion. The upper and lower body segments 117 and 119 are interconnected at selected angles relative to each other and relative to the lower end portion 108 so as to define a hydrant-head-receiving area 121 (FIGS. 1 and 2). The hydrant-head-receiving area 121 is shaped and sized to receive the head 12 of the fire hydrant 10 (FIG. 1) when the lifting paddle 100 is attached to the fire hydrant. The contoured section 104 provides sufficient clearance between the paddle's body region 102 and the fire hydrant's head 12 so the lifting paddle does not engage the fire hydrant's head. In the exemplary embodiment, the lifting paddle 100 is made of steel or other suitable metal with a thickness of approximately ½ inch, so the paddle's body region 102 is sufficiently strong to lift the fire hydrant 10 and extension pipe 36 as a unit substantially without flexing or bending at the contoured section 104 under the weight of the fire hydrant and extension pipe.

The upper body segment 117 of the lifting paddle's body region 102 is integrally connected to the lifting paddle's upper portion 112. The upper portion 112 has an enlarged engagement portion 113 with an aperture 115 that is shaped and sized to receive the lifting cable 200 therethrough. The lifting cable 200 loops through the aperture 115 in the engagement portion 113 and connects to itself so as to form a conventional cable junction 208. Accordingly, the lifting paddle 100 is pivotally attached to the loop in the lifting cable 200.

Figure 4:
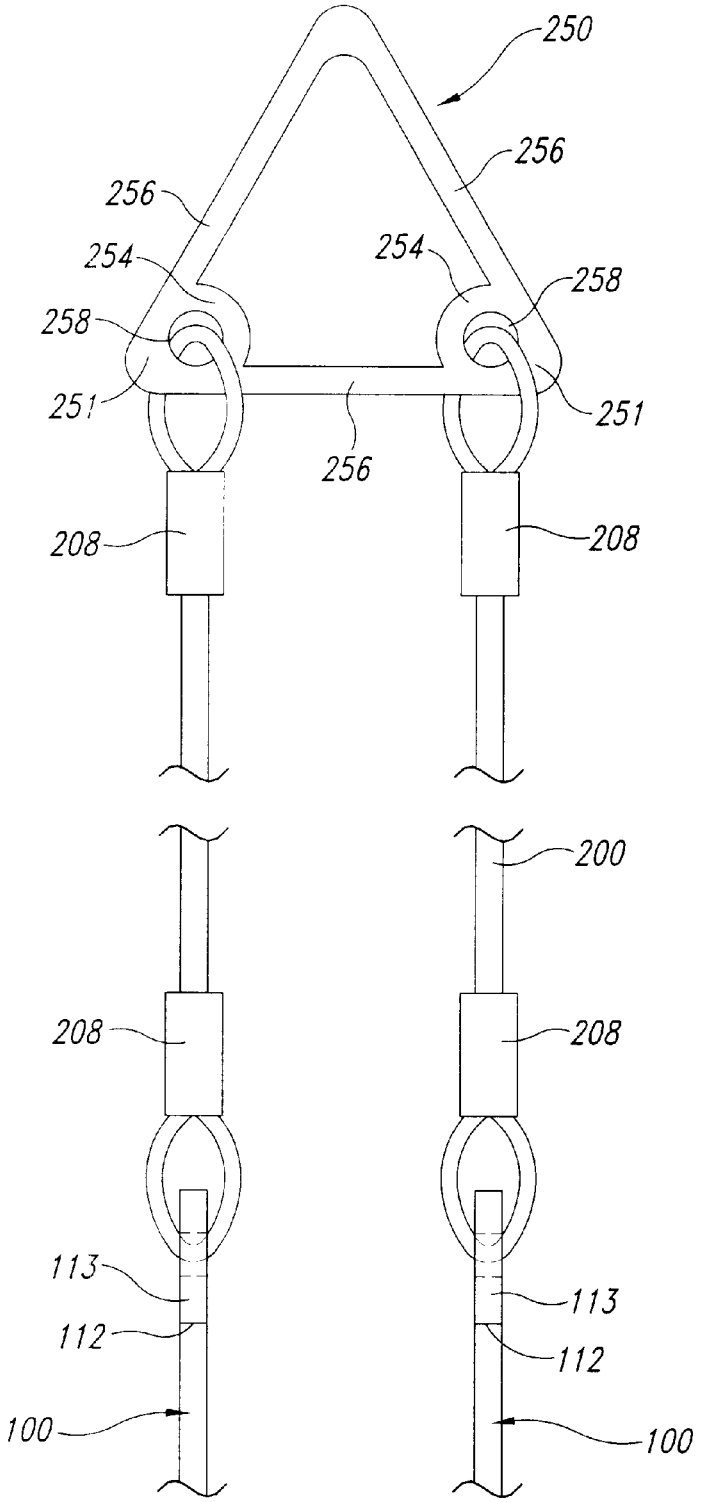
FIG. 4 is a partial side elevation view of the lifting paddle, lifting cable, and lifting triangle of the lifting apparatus of FIG. 1.

As best seen in FIGS. 1 and 4, the lifting cable 200 extends away from the lifting paddle 100 and connects to the lifting triangle 250. The lifting cable 200 is looped through corner portions of the lifting triangle 250 and connected to itself to form a conventional cable junction so the cable is securely yet pivotally fixed to the lifting triangle. In the preferred embodiment, the lifting cable is a ½ inch cable having a length of approximately 27 inches, although the cable thickness and length can be varied depending upon the strength and size requirements for the lifting harness 300.

As best seen in FIG. 4, the lifting triangle 250 has three side segments 256 integrally connected to form an equilateral triangle. The lifting triangle 250 also has stability members 254 integrally connected to the side segments 256 at the lifting triangle's two lower corners 251, and the stability members each include or form an eyelet 258 therein. The eyelets 258 are shaped and sized to receive the upper portion of the lifting cable so the lifting cable loops through the respective eyelet and connects to itself at the cable junction 208 so as to securely interconnect the lifting triangle to the lifting cable. The stability members 254 hold the lifting cables in a spaced-apart relationship. Accordingly, the lifting triangle 250 prevents the lifting cables 200 from sliding toward each other along the lower segment 256 of the lifting triangle during a lifting procedure, which could create an imbalance of the lifting harness 300 and fire hydrant 10. The lifting triangle 250, thus, keeps the lifting cables 200 and lifting paddles 100 spaced apart with the fire hydrant position therebetween in an aligned and balanced position for easy and safe maneuverability of the fire hydrant 10 and extension pipe 36 (FIG. 1) during the lifting procedure.

The stability members 254 with eyelets 258 therein are also adapted to allow the upper ends of the lifting cable 200 to pivot relative to the respective eyelet so the lifting harness will not bind on itself during a lifting operation as the lifting triangle is lifted relative to the lifting paddles 100 to put the lifting harness into vertical tension or when the lifting triangle is lowered relative to the lifting paddles to release the vertical tension, such as during a process of removing the lifting paddles from the fire hydrant.

The lifting harness 300 shown in FIG. 1 removably connects to the fire hydrant's protruding ports 26 in the following manner. One of the port caps 20 is removed from its respective port 26. A wrench can be applied to the port nut 22 on the port cap if the port cap is more than hand-tight. The aperture 110 in the lifting paddle's lower end portion 108 is then slipped over the port 26, and the port cap 20 is replaced. It is preferable to replace the port cap far enough so that the paddle 100 does not slip off, but not so far as to prevent the paddle 100 from rotating around the port relative to the fire hydrant's body 16. By rotatably connecting the lifting paddles 100 to the ports 26 while being lifted, the fire hydrant 10 can rotate about a horizontal axis that is coaxially aligned with the ports 26. Accordingly, the fire hydrant 10 can rotate between a horizontal position and vertical position, while the lifting paddles 100 remain in a substantially vertical position.

In operation, as an example, the lifting harness 300 is connected to a fire hydrant 10 that has been transported to an installation site and is laying horizontally on the ground or the bed of a truck or the like. The lifting paddles 100 are attached to the fire hydrant's ports 26 as described above, and the lifting triangle 250 is attached to the backhoe (not shown) or other lifting device that generates a sufficiently large lifting force. The backhoe raises the lifting triangle 250, lifting cables 200 and lifting paddles 100 to remove slack in the lifting harness 300, so that the lifting harness is in a substantially vertical position while the fire hydrant 10 remains horizontal.

As the upward lifting force continues to be exerted on the lifting triangle 250, the lifting force is transmitted to the ports 26 through the lifting paddles 100, which causes the head 12 of the fire hydrant to raise off the ground while the bottom end of the extension pipe 36 stays on the ground, such that the fire hydrant pivots about the bottom end of the extension pipe. As discussed above, the ports 26 rotate within the aperture 110 in the lifting paddles 100 as the fire hydrant pivots to a vertical position. The lifting continues until the fire hydrant is in a substantially vertical position, with the bottom end of the extension pipe 36 still on or adjacent to the ground.

More lifting force is applied, which further lifts the vertically oriented fire hydrant 10 so the extension pipe is lifted a selected distance above the ground. The fire hydrant 10 and extension pipe 36 can then be moved with the lifting harness 300 as a unit to a location above the area to which the extension pipe is to be clamped, for example, to the water supply pipe 50. The fire hydrant 10 and extension pipe 36 are lowered with the lifting harness 300 to a selected position and secured into place, such as bolted to the water supply pipe 50. Once the fire hydrant 10 is installed and secured in its selected position, vertical tension is released from the lifting harness 300, and the lifting harness is detached from the fire hydrant by unscrewing the port caps 20 and removing the lifting paddles 100 from the ports 26. The port caps 20 are then replaced.

The lifting harness 300 is also usable to remove a fire hydrant 10 from a water supply pipe 50 by attaching the lifting harness to the fire hydrant as discussed above, and putting the lifting harness in vertical tension. The fire hydrant 10 and extension pipe 36 are then disconnected from the water supply pipe in a conventional manner, while the lifting harness 300 holds the fire hydrant and extension pipe in a substantially vertical position. The lifting harness 300, the fire hydrant 10, and extension pipe are then lifted as a unit away from the water supply pipe 50 and moved to a selected position over the ground or other receiving area. The fire hydrant 10 and extension pipe 36 are then lowered so as to engage the ground and pivot relative to the lifting paddles 100 from the vertical position to the horizontal position. Vertical tension is then released from the lifting harness 300, and the lifting paddles 100 removed from the fire hydrant's ports. While the installation and removal processes are described herein with the fire hydrant 10 being connected to the extension pipe 36, the fire hydrant and extension pipe need not be connected together for the fire hydrant installation or removal processes using the lifting harness 300 of the present invention.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A fire hydrant lifting harness assembly for use with a lifting device, comprising:

a lifting triangle having first, second and third corner portions, the first corner portion being attachable to the lifting device and the second and third corner portions each having an eyelet formed therein;

two flexible coupling members, each having a first end and a second end, the first end of each flexible coupling member attached to a respective one of the second and third corner portions at the eyelet; and two lifting paddles, each having a first end and a second end, the first end of each paddle attached to the second end of one of the respective flexible coupling members, the second end of each paddle having a port receiving portion structured to receive a respective port extending from a fire hydrant, the lifting paddles being contoured such that first and second ends of each paddle lie substantially in a first plane, and a middle portion of each respective paddle lies in a second plane different than the first plane.

2. The lifting harness assembly of claim 1 wherein the lifting triangle is made from a single piece of cast metal.

3. The lifting harness assembly of claim 1 wherein the lifting paddles are substantially rigid members.

4. The lifting harness assembly of claim 1 wherein the lifting paddles are pivotally connectable to the ports.

5. The lifting harness assembly of claim 1 wherein, when seated against the object to be lifted, the port receiving portion in each of the paddles is structured to provide a sealing area around the respective port.

6. A lifting harness for use with a fire hydrant having a head protruding from and having a greater circumference than a hydrant body, the fire hydrant also including two ports having a first diameter and two port caps having a second diameter, the lifting harness comprising:

a lifting triangle having first, second and third corner portions, the first corner portion being attachable to a lifting device and the second and third corner portions each having an eyelet formed therein;

two lifting paddles, each having a first end and a second end, the lifting paddles being contoured such that first and second ends of each paddle lie substantially in a first plane, and a middle portion of the respective paddles lies in a second plane different than the first plane, the second end of each paddle having a collar portion structured to receive a respective port extending from a fire hydrant; and a flexible coupling member coupled to the first end of each respective lifting paddle and the second and third corner portions of the lifting triangle.

7. The lifting harness of claim 6 wherein the paddles have a contoured shape structured to avoid contact with a protruding head of the fire hydrant.

8. The lifting harness of claim 6 wherein the lifting triangle is made from a single piece of cast metal.

9. The lifting harness of claim 6 wherein the lifting paddles are substantially rigid members.

10. The lifting harness of claim 6 wherein the lifting paddles are pivotally connectable to the ports.

11. The lifting harness of claim 6 wherein, when seated against the object to be lifted, the collar portion in each of the paddles is structured to provide a sealing area around the respective port.

12. A lifting apparatus for lifting an object having a first and a second projection extending therefrom, the apparatus comprising:

an attachment member having an attachment end that is attachable to a lifting device, and having a coupling end including first and second coupling points held in a separated relationship with respect to one another;

at least one non-rigid coupling member connected to the first and second coupling points of the attachment member; and at least two rigid paddles, each rigid paddle connected to the attachment member by the at least one coupling member, each rigid paddle having an aperture within that is sized to accept one of the respective projections of the object therethrough, the rigid paddles being contoured such that first and second ends of each paddle lie substantially in a first plane, and a middle portion of the respective paddles lies in a second plane different than the first plane.

13. The lifting apparatus of claim 12 wherein the paddles have a contoured shape structured to clear a protruding head of a fire hydrant.

14. The lifting apparatus of claim 12 wherein the attachment member is a lifting triangle made from a single piece of cast metal.

15. The lifting apparatus of claim 12 wherein the lifting paddles are pivotally connectable to the projections.

16. The lifting apparatus of claim 12 wherein, when seated against the object to be lifted, the aperture in each of the paddles is shaped to provide a sealing area around the respective projection.

17. A lifting harness for use in conjunction with a lifting device to lift a fire hydrant, the lifting harness comprising:

a lifting contact structured to be coupled to the lifting device;

two lifting paddles, each having a first end and a second end, the lifting paddles being contoured such that first and second ends of each paddle lie substantially in a first plane, and a middle portion of the respective paddles lies in a second plane different than the first plane the second end of each paddle having a port receiving portion shaped and sized to receive a respective port extending from a fire hydrant, and structured to be held in place by a port cap of the fire hydrant; and a flexible coupling member coupled between the lifting contact and the two lifting paddles.

18. The lifting harness of claim 17 wherein the port receiving portion of each lifting paddle is sized to accept the entire respective port therethrough.

19. The lifting harness of claim 17 wherein the port receiving portion of each lifting paddle is sized to be greater than any portion of the port.

20. The lifting harness of claim 17 wherein the greatest size of the port cap is greater than the greatest size of the port.

21. The lifting harness of claim 17 wherein each paddle is shaped so that when placed over the respective port of the fire hydrant, the paddle does not contact the fire hydrant other than at the port.

22. The lifting harness of claim 17 wherein the lifting paddles are connected to the flexible coupling members at a location between the lifting device and a top of the fire hydrant.

23. A fire hydrant lifting device for lifting a fire hydrant including a head, two ports and two port caps, the lifting device comprising:

a lifting triangle having two eyelets held in a spaced-apart configuration;

first and second cables each having a first and a second end, and each cable coupled to a respective eyelet at the first end; and first and second lifting paddles each coupled to the second end of a respective one of the cables, each paddle including an aperture sized to be greater than any portion of the ports and sized to be less than a portion of the port caps, and each paddle structured so that the portion of each respective paddle coupled to the cable and the aperture of the respective paddle are located substantially in a first plane and an intermediate portion of each respective paddle intermediate the portion coupled to the cable and the aperture is not located in the first plane wherein the paddle does not contact any portion of the fire hydrant other than the port when the aperture of the respective paddle is placed over the port.

24. The fire hydrant lifting device of claim 23 wherein the aperture of each lifting paddle is sized to accept the entire respective port therethrough.

25. The fire hydrant lifting device of claim 23 wherein the greatest size of the port cap is greater than the greatest size of the port.

26. The fire hydrant lifting device of claim 23 for use with a fire hydrant having an upper head portion wherein the lifting paddles are connected to the respective cable at a location intermediate the lifting device and the head portion of the hydrant.

* * * * *